US005253370A

United States Patent [19]

Mead

[11] Patent Number: 5,253,370

[45] Date of Patent: Oct. 19, 1993

[54] DUAL PURPOSE ADJUSTABLE BASE FOR MOUNTING PREFOLDED "POCKET SILK" HANKERCHIEFS

[76] Inventor: Charles B. Mead, P.O. Box 503, Chelmsford, Mass. 01824-0503

[21] Appl. No.: 691,716

[22] Filed: Jul. 3, 1991

[51] Int. Cl.[5] ..... A41B 15/00

[52] U.S. Cl. ..... 2/279; 2/249; 2/247; 40/642; 206/38; 206/278; 206/457

[58] Field of Search ..... 2/249, 247, 279; 206/38, 278, 457; 40/642

[56] References Cited

U.S. PATENT DOCUMENTS

| | | | |
|---|---|---|---|
| 2,022,793 | 12/1935 | Trickel | 2/279 |
| 2,060,729 | 11/1936 | Gilgenbach | 2/279 |
| 3,371,829 | 3/1968 | Phillips | 2/279 |
| 3,512,182 | 5/1970 | Bezanilla | 2/279 |
| 3,786,520 | 1/1974 | Harmon | 2/279 |
| 4,083,446 | 4/1978 | Schuchman, Sr. | 2/279 |

*Primary Examiner*—Clifford D. Crowder
*Assistant Examiner*—Gloria Hale

[57] ABSTRACT

A unibody base is formed by joining two sections of leatherette. Both sections are 2¼" wide and rectangular except that the 4" long Upper Section flares out to both sides at the top to a width of 3¼" from a point 2' below. The stitching is left open at the top to accommodate a three dimensional, simulated pocket silk handkerchief. The leatherette front of the Upper Section is mounted on a thin piece of rigid material 4" long having a loop VELCRO back, under the lower edge of which is sewn an additional 1½" long piece of taffeta. The pliable Lower Section consists of a 5" leatherette front covered at the back with taffeta to which a ½" high width of hook VELCRO is sewn within its lower edge. The Lower Section is superimposed over the Upper Section 1½" above the junction of the taffeta strip. The sections are joined by stitching the vertical edges, including those of the taffeta which is also sewn horizontally across the back of the Lower Section forming a pocket 3" deep. The hook VELCRO tip is folded back and secured at any elevation along the back of the Upper Section. As the length of the base is increased beyond the established minimum rigidity the taffeta section of the business card pocket becomes available. Rigidity is maintained by pushing the business cards further into the expanding pocket.

1 Claim, 6 Drawing Sheets

DUAL PURPOSE ADJUSTABLE BASE FOR MOUNTING PREFOLDED "POCKET SILK" HANKERCHIEFS

BACKGROUND OF INVENTION (1) Field of Invention

The invention is a component of a gentleman's fashion accessory, specifically a pocket silk handkerchief frequently worn by well dressed gentlemen in the breast pocket of their suit or jacket. Such a handkerchief is generally utilized more for decorative than functional purposes. As a decoration, it generally matches the necktie pattern, or accents the principal color within the pattern. The purpose of the base which is the subject of this invention is to accommodate a pre-folded, stylish, three dimensional simulated pocket silk handkerchief so that it may be maintained at a point just below the opening of the breast pocket. While the width of the breast pocket of a gentleman's suit or jacket is standardized at 3½", the depth of the breast pocket is not and varies over a range of 1¼" from approximately 4" to 5¼". Accordingly, the invention is designed to support a handkerchief in a range of elevated positions while maintaining continuous, variable rigidity. Since it is also common practice for gentlemen to carry business cards, the base is built to form a pocket within to serve as a business card holder. This business card pocket is designed to expand as the length of the base is increased, and to utilize the business cards themselves as the necessary source of additional rigid support. The design of the pre-folded simulated pocket silk handkerchief is not itself the subject of this invention.

(2) Description of Prior Art

There have been numerous previous attempts to resolve the problem outlined. In a prior patent Schuchman, Sr. U.S. Pat. No. 4,083,446-1978 discloses a bulky device consisting of two individual component parts, one component of which has a decorative handkerchief permanently affixed to each vertical end. These ornamental handkerchiefs, being of two distinct colors, can be alternately displayed by separating the components and inverting the component having the decorative handkerchief to display the desired color i.e., blue on one end, red on the other or some other color combination, so the user may readily decide which color to display. The decorative component is then attached to a single rigid component that remains concealed in the pocket of the jacket to provide the required support. The two items are attached by means of two opposing vertical hook and loop fastening or VELCRO strips sewn one to each component. The height of visible component is varied by varying the quantum of VELCRO up or down used to secure it to the second rigid component that remains hidden in the breast pocket. This design display has several drawbacks in that the decorative handkerchief is necessarily two dimensional and lacking in style. More importantly the adjustment itself is unwieldy to make. The two separate components must both be removed from the pocket, matched and rematched in a trial and error fashion in order to obtain the desired results.

Other prior art involved the use of complex series of fasteners to adjust for breast pocket depth. The components of all prior designs failed to meet a simple unibody adjustable format that is decorative, functional, simple to adjust, lightweight and attractive. My invention is designed to easily slide in and out of the breast pocket for purposes of accessing its contents without diminishing or detracting from the fashion statement which the three dimensional, pre-folded, pocket handkerchief is intended to fulfill for the wearer.

DESCRIPTION OF THE PREFERRED EMBODIMENT

The invention is a business card holder built into a base which also serves as an adjustable support for a simulated pocket silk handkerchief (as shown in FIGS 2A, 2B, 3A and 3B). The base is flat, and creates no bulges in the jacket pocket. It is easily accessible and yet securely placed. The 4" long Upper Section of the base is not completely rectangular, but is flared out gradually towards the top from a point 2" below to a width slightly less than the standard 3½" breast pocket width found in virtually all gentlemen's suits and jackets. The slight curvature resulting allows the base to slide easily in and out of the user's pocket. It also ensures that the width at the top, where it is ultimately stitched to a simulated pocket handkerchief, is of appropriate dimension to support a full-bodied, three dimensional fashionably folded handkerchief.

The invention as shown in FIGS. 4A and 4B, consists of essentially rectangular sections of decorative vinyl leatherette material each approximately 2¼' wide (reference numbers 3 and 6) that are permanently joined along their vertical edges by sewing at the area indicated at (10). The Upper Section (11) is not completely rectangular as stated above. The leatherette front (3) on the Upper Section (11) is mounted on a thin piece of rigid material (2) such as chipboard by known methods such as adhesives or sewing along the vertical edges.

The rear surface of the chipboard (2) is covered by known methods i.e., sewing and/or adhesive with loop fastener material (4) such as the material sold under the trademark VELCRO. Before the loop fastener material (4) is fully attached to the upper area of the chipboard (2) a decorative pre-folded pocket silk handkerchief (13) is placed between the layers (4) and (2) and is attached by sewing. Under the lower edge of the loop material, between the loop material (4) and the rigid material (2) and extending out in a downward direction is sewn an additional 1½" long piece of fabric (5) such as taffeta. The Lower Section (12) of the base has a 5" long leatherette front (**6*a*) which has a rear surface covered with a taffeta lining (6*b*) by known methods. The Lower Section is completely pliable since it does not contain a rigid material as found in the Upper Section. Along the width of the lower edge of the Lower Section and the fabric (taffeta) surface is sewn an approximately ½" high piece of hook fastening material(7**).

The pliable lower section (12) is superimposed at (14) over the Upper Section approximately 1½" above the junction of the taffeta strip to form the top opening of the pocket. The sections (11 and 12) and the material layers **6*a*, 6*b*, 5, 3, 2 and 4** are joined by stitching along the vertical edges including those of the 1½" (taffeta) fabric piece previously added to the lower edge of the Upper Section which is also sewn horizontally across the back of the Lower Section forming a pocket with a total depth of 3", 1½" above the rigid minimum depth, and 1½" below within the pliable section. The two sections are thus joined into a base of unibody construction which may now be folded back upon itself to adjust for overall depth by taking the hook VELCRO tip at the bottom edge of the Lower Section and securing it at any elevation along the loop VELCRO back of the Upper Section.

As the height of the VELCRO connection point is lowered, the overall length of the unibody base is increased and the depth of the business card pocket is incrementally available up to its full limit. By placing the business cards deeper into the expanded pocket additional rigidity is provided to maintain complete rigidity at any desired elevation. The product is thus simply adjusted to conform to any given breast pocket depth of a gentleman's suit in which it is placed.

Prior art has addressed itself to both of the functions described but has always had to use two separable and distinct pieces to accomplish the goal, and has never utilized the contents of one function, i.e., the business cards within the pocket, to resolve the design problem in the second function of maintaining rigidity of the base over a plurality of elevated positions.

BRIEF DESCRIPTION OF THE DRAWINGS

FIGS. 4A and 4B are shown as expanded drawings identifying all components.

SUMMARY

Figure 1A:
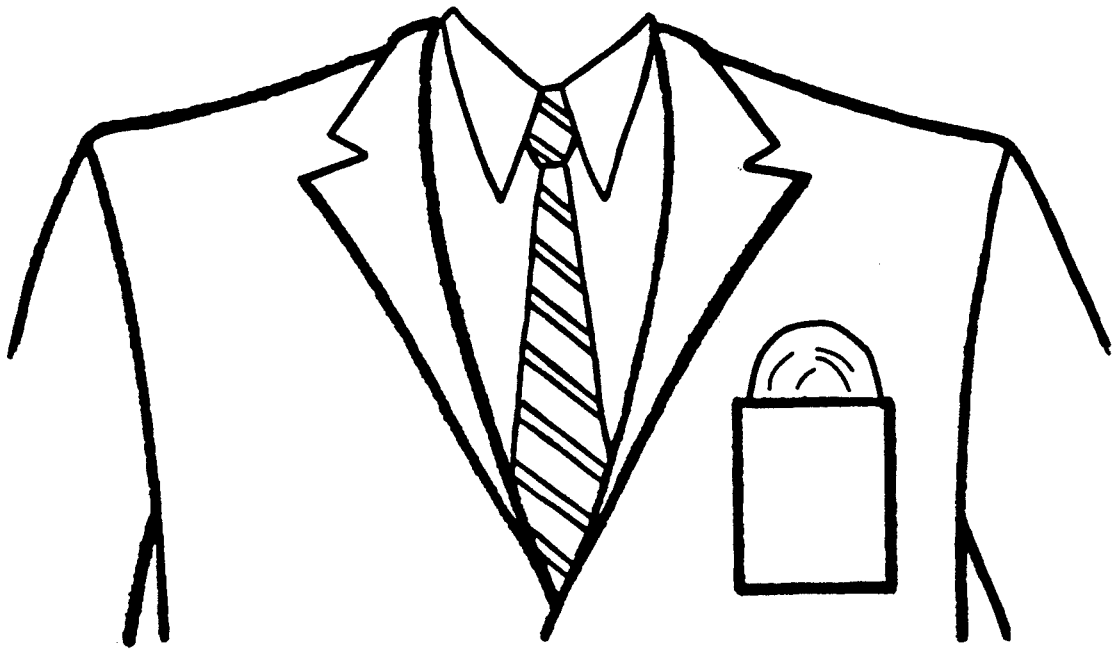
FIG. 1 depicts the invention in place within the pocket of a suit.
Figures 2A, 2B:
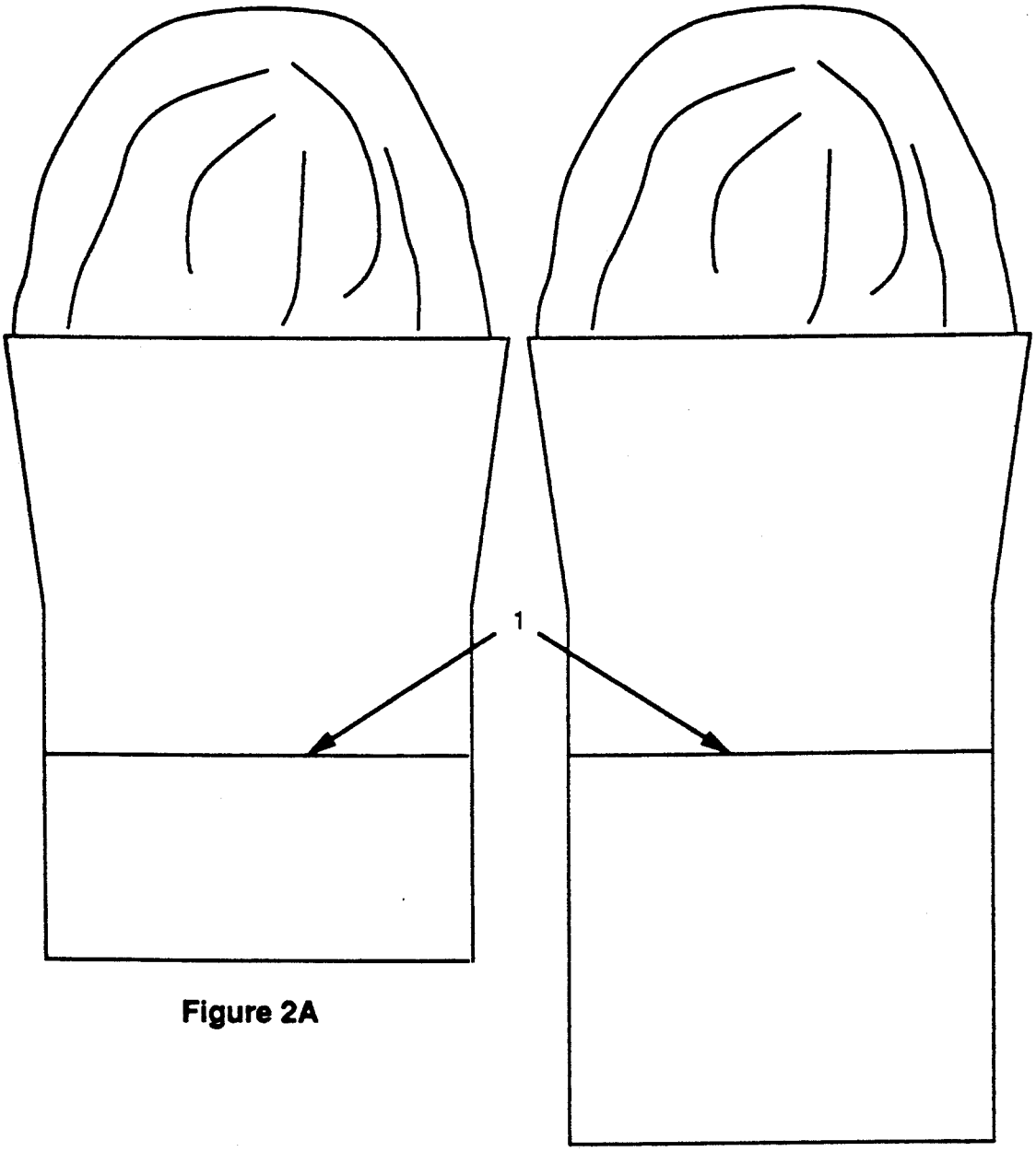
FIGS. 2A and 2B represent the front view of the invention at minimum and maximum depth. The differing area below the horizontal line (14) in these two figures represents the limits in depth variation of the business card pocket.
Figure 3A:
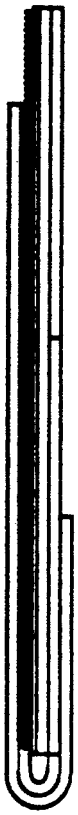
FIGS. 3A and 3B are side views of FIGS. 2A and 2B.
Figure 3B:
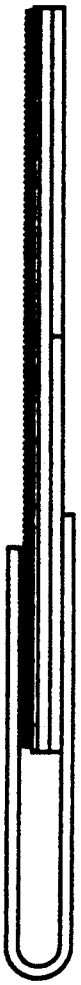
Figure 4A:
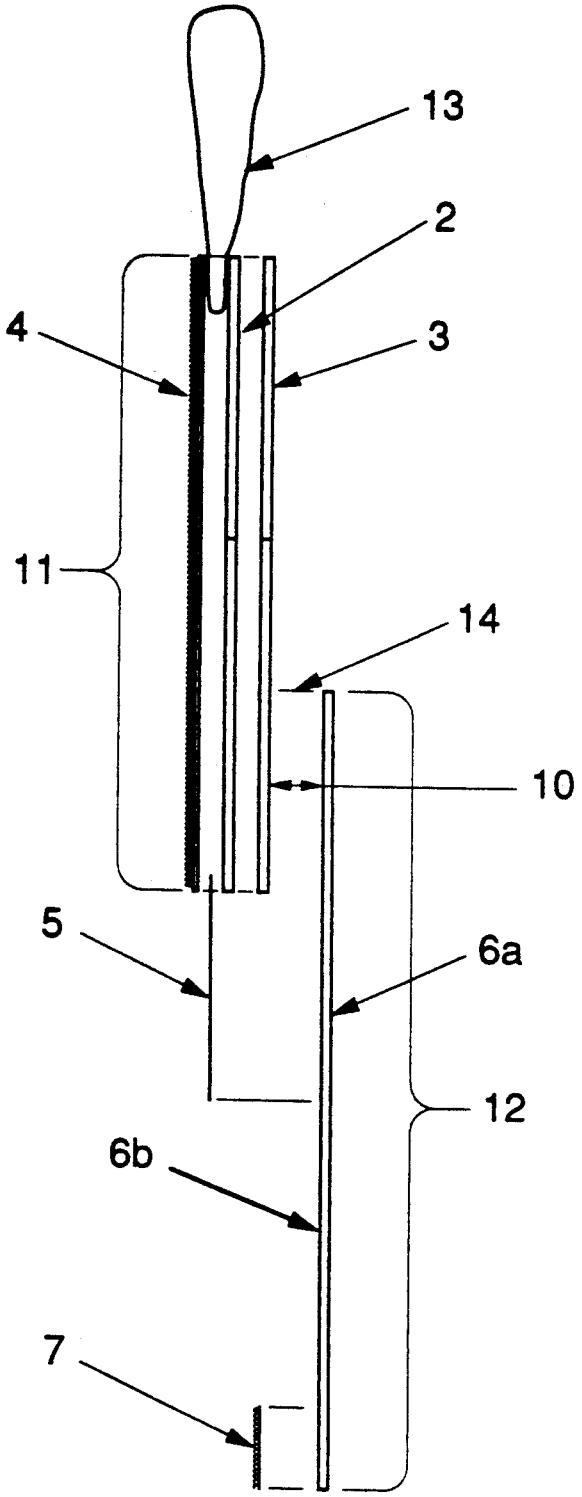
FIGS. 4A and 4B are fully extended side views of FIGS. 3A and 3B before the base is folded back onto itself to adjust its depth prior to insertion into the breast pocket of a suit or jacket.
Figure 4B:
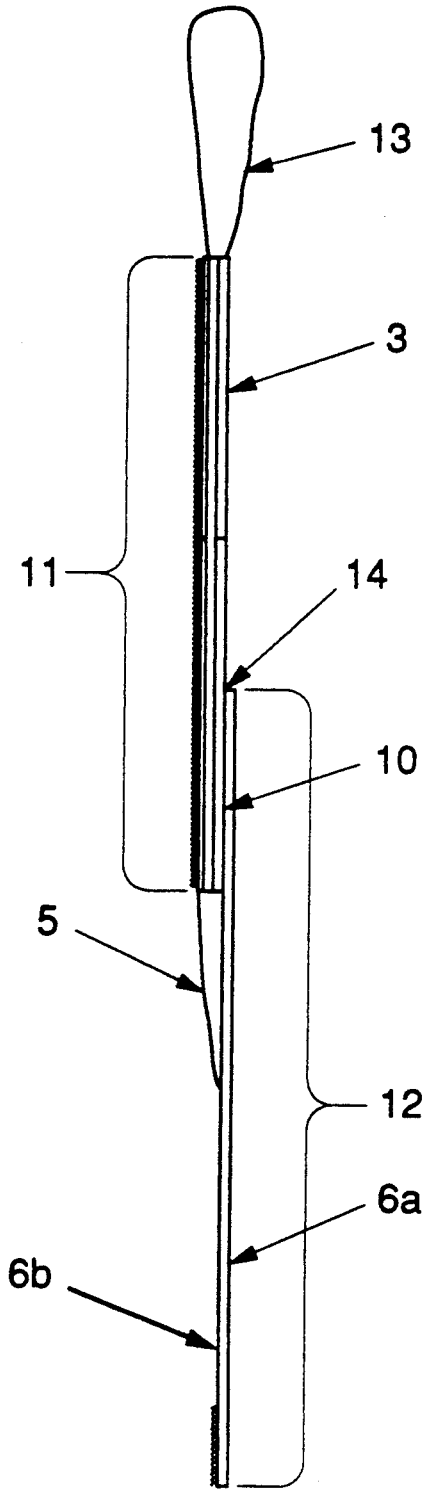
Figure 5A:
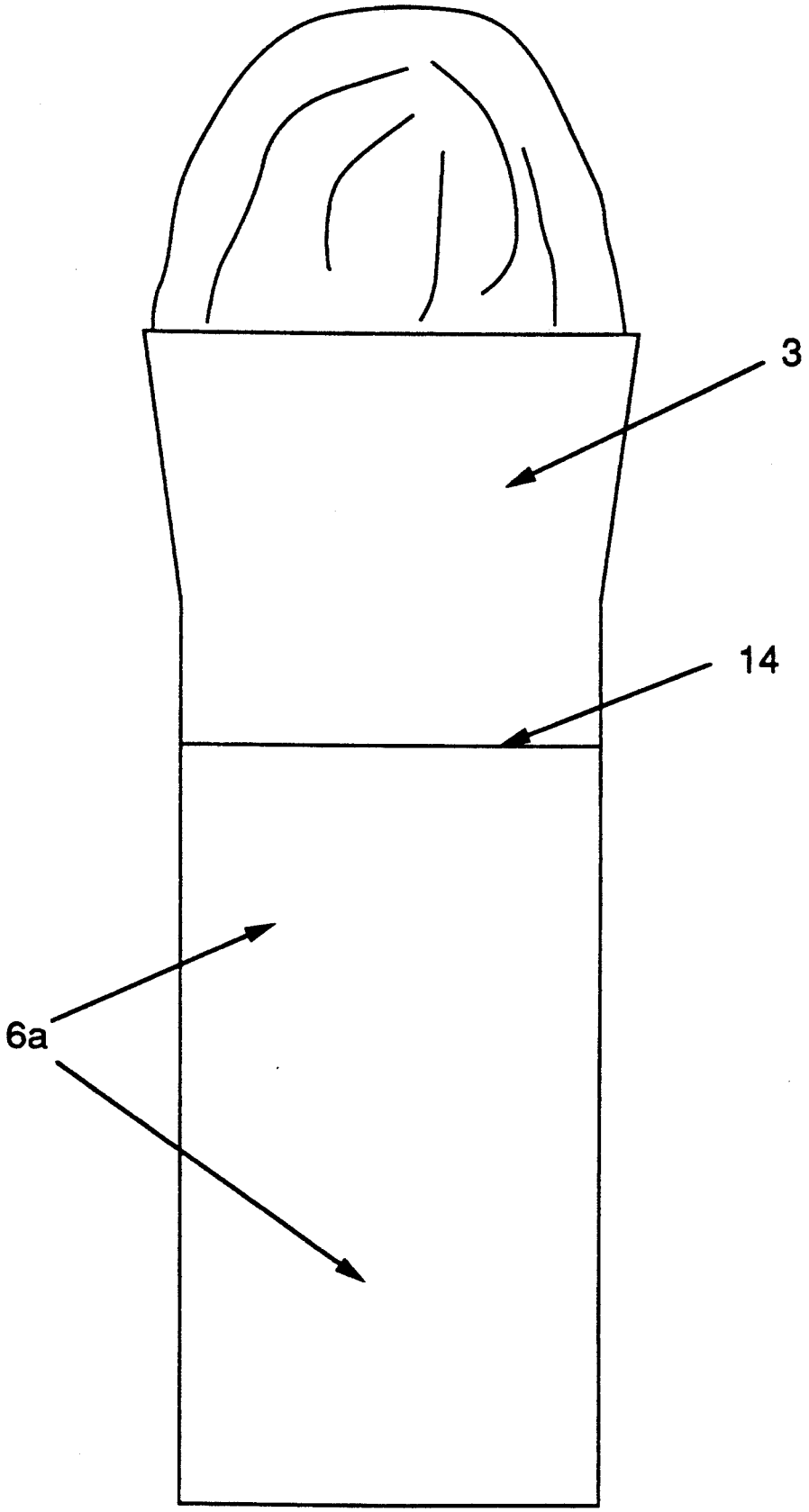
FIG. 5A is a front view of FIG. 4B, the line 1 shown indicates the folding point for maximum length of the base corresponding to the length of FIG. 2B and/or 3B.
Figure 5B:
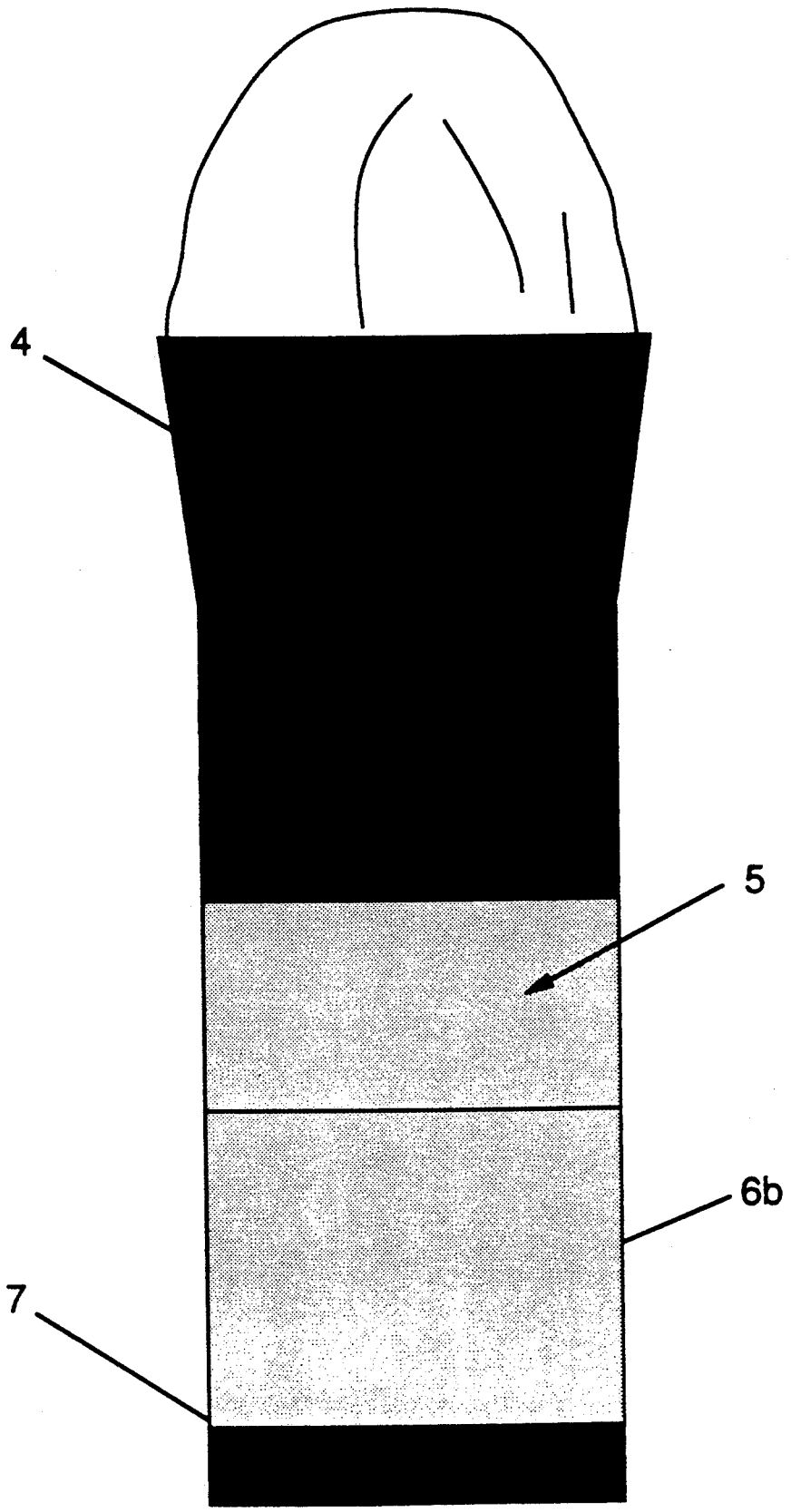
FIG. 5B is a rear view of FIG. 5A identifying the key component parts which make possible the continuously adjustable depth.

The preferred embodiments of the invention are adequately addressed above. As indicated, the invention is intended to be utilized with a pre-folded, simulated pocket silk handkerchief sewn into its upper edge. The design of the pre-folded handkerchief is not per se the subject of this invention, but rather represents one of the two purposes for which the base is designed, the first being to support the handkerchief, the second to serve as a business card holder.

I claim:

1. A combination decorative pocket handkerchief and business card holder comprising:

a base having a front and a back and an upper and lower section; said upper section is constructed of a rigid and predominately rectangular piece of material having a side edge, top end, bottom end front and a back surface; said upper section front surface is covered with a vinyl material and the upper section back surface is covered with loop fastener material and wherein a pre-folded handkerchief portion is placed at the top and attached between the rigid material and the loop fastener material, while at the bottom of the upper section across its width is added a short length of taffeta having side edge; said lower section has a side edge front and rear surface, a lower edge and an upper portion, wherein said lower section front surface is constructed of pliable vinyl and said lower section rear surface is of decorative fabric; an opening of a pocket is formed when the upper portion of the lower section is superimposed over a lower portion of the upper section and the two sections are attached along their side edges including the side edges of the added taffeta length which is also stitched horizontally to establish the maximum depth of the pocket; said lower edge of the lower section is covered with a strip of hook material and wherein said lower edge is folded back and attached to the aforesaid loop backing of the upper section, whereby the effective depth of the pocket is variable so that business cards inserted into the pocket provide additional rigidity when required as the length of the base is increased and varied by shifting the interfacing of the hook and the loop.

* * * * *